US007476099B2

(12) United States Patent
Stephens et al.

(10) Patent No.: US 7,476,099 B2
(45) **Date of Patent: *Jan. 13, 2009**

(54) REMOVABLE LIGHT-OFF PORT PLUG FOR USE IN BURNERS

(75) Inventors: George Stephens, Humble, TX (US); David B. Spicer, Houston, TX (US)

(73) Assignee: ExxonMobil Chemicals Patents Inc., Houston, TX (US)

( * ) Notice: Subject to any disclaimer, the term of this patent is extended or adjusted under 35 U.S.C. 154(b) by 18 days.

This patent is subject to a terminal disclaimer.

(21) Appl. No.: 10/388,893

(22) Filed: Mar. 14, 2003

(65) Prior Publication Data

US 2003/0175632 A1 Sep. 18, 2003

Related U.S. Application Data

(60) Provisional application No. 60/365,081, filed on Mar. 16, 2002.

(51) Int. Cl.
*F23D 14/16* (2006.01)

(52) U.S. Cl. ..... 431/115; 431/5; 431/9; 126/91 A

(58) Field of Classification Search ..... 431/6, 431/13, 17, 115, 153, 154, 155, 159, 186, 431/189, 258, 263, 278, 279, 123, 5, 9, 215; 126/91 A See application file for complete search history.

(56) References Cited

U.S. PATENT DOCUMENTS

| | | | | |
|---|---|---|---|---|
| 1,938,708 A | * | 12/1933 | McCutcheon | 431/186 |
| 2,368,370 A | | 1/1945 | Maxon | 158/7 |
| 2,813,578 A | | 11/1957 | Ferguson | 158/1 |
| 2,918,117 A | | 12/1959 | Griffin | 158/1 |
| 2,983,312 A | | 5/1961 | Finley et al. | 158/79 |
| 3,880,570 A | | 4/1975 | Marshall | 431/4 |
| 4,004,875 A | | 1/1977 | Zink et al. | 431/9 |
| 4,089,629 A | | 5/1978 | Baumgartner et al. | 431/9 |
| 4,130,388 A | | 12/1978 | Flanagan | 431/116 |
| 4,230,445 A | | 10/1980 | Janssen | 431/116 |
| 4,257,763 A | | 3/1981 | Reed | 431/188 |
| 4,575,332 A | | 3/1986 | Oppenberg et al. | 431/9 |

(Continued)

FOREIGN PATENT DOCUMENTS

| | | |
|---|---|---|
| CA | 1169753 | 6/1984 |

(Continued)

OTHER PUBLICATIONS

Chemical Engineering Progress, vol. 43, 1947, "The Design of Jet Pumps" by A. Edgar Kroll, pp. 21-24, vol. 1, No. 2.

(Continued)

*Primary Examiner*—Jiping Lu

(57) ABSTRACT

An improved burner and a method for combusting fuel used in furnaces such as those found in steam cracking. The burner includes a burner tube having a downstream end and an upstream end, a burner tip adjacent a first opening in the furnace, so that combustion of the fuel takes place at the burner tip, a lighting chamber adjacent to the first opening in the furnace, and a removable lighting chamber plug having a shape effective to substantially fill the lighting chamber when positioned within the lighting chamber.

13 Claims, 8 Drawing Sheets

U.S. PATENT DOCUMENTS

| | | | | |
|---|---|---|---|---|
| 4,629,413 | A | 12/1986 | Michelson et al. | 431/116 |
| 4,708,638 | A | 11/1987 | Brazier et al. | 431/116 |
| 4,739,713 | A | 4/1988 | Vier et al. | 110/263 |
| 4,748,919 | A | 6/1988 | Campobenedetto et al. | 110/264 |
| 4,815,966 | A | 3/1989 | Janssen | 431/174 |
| 4,828,483 | A | 5/1989 | Finke | 431/11 |
| 4,963,089 | A | 10/1990 | Spielman | 431/351 |
| 4,995,807 | A | 2/1991 | Rampley et al. | 431/9 |
| 5,044,931 | A | 9/1991 | Van Eerden et al. | 431/8 |
| 5,073,105 | A | 12/1991 | Martin et al. | 431/116 |
| 5,092,761 | A | 3/1992 | Dinocolantonio | 431/115 |
| 5,098,282 | A | 3/1992 | Schwartz et al. | 431/9 |
| 5,135,387 | A | 8/1992 | Martin et al. | 431/116 |
| 5,152,463 | A | 10/1992 | Mao et al. | 239/402 |
| 5,154,596 | A | 10/1992 | Schwartz et al. | 431/9 |
| 5,195,884 | A | 3/1993 | Schwartz et al. | 431/8 |
| 5,201,650 | A | 4/1993 | Johnson | 431/9 |
| 5,224,851 | A | 7/1993 | Johnson | 431/115 |
| 5,238,395 | A | 8/1993 | Schwartz et al. | 431/10 |
| 5,254,325 | A | 10/1993 | Yamasaki et al. | 423/450 |
| 5,263,849 | A | 11/1993 | Irwin et al. | 431/6 |
| 5,269,679 | A | 12/1993 | Syska et al. | 431/9 |
| 5,275,554 | A | 1/1994 | Faulkner | 431/115 |
| 5,284,438 | A | 2/1994 | McGill et al. | 431/9 |
| 5,299,930 | A | 4/1994 | Weidman | 431/10 |
| 5,316,469 | A | 5/1994 | Martin et al. | 431/116 |
| 5,326,254 | A | 7/1994 | Munk | 431/115 |
| 5,344,307 | A | 9/1994 | Schwartz et al. | 431/9 |
| 5,350,293 | A | 9/1994 | Khinkis et al. | 431/116 |
| 5,370,526 | A | 12/1994 | Buschulte et al. | 431/116 |
| 5,407,345 | A | 4/1995 | Robertson et al. | 431/115 |
| 5,413,477 | A | 5/1995 | Moreland | 431/9 |
| 5,470,224 | A | 11/1995 | Bortz | 431/182 |
| 5,472,341 | A | 12/1995 | Meeks | 431/243 |
| 5,542,839 | A | 8/1996 | Kelly | 431/10 |
| 5,562,438 | A | 10/1996 | Gordon et al. | 431/115 |
| 5,584,684 | A | 12/1996 | Dobbeling et al. | 431/285 |
| 5,603,906 | A | 2/1997 | Lang et al. | 422/182 |
| 5,611,682 | A | 3/1997 | Slavejkov et al. | 431/8 |
| 5,624,253 | A | 4/1997 | Sulzhik et al. | 431/116 |
| 5,685,707 | A | 11/1997 | Ramsdell et al. | 431/90 |
| 5,688,115 | A | 11/1997 | Johnson | 431/9 |
| 5,807,094 | A | 9/1998 | Sarv | 431/177 |
| 5,813,846 | A | 9/1998 | Newby et al. | 431/9 |
| 5,980,243 | A | 11/1999 | Surbey et al. | 431/347 |
| 5,984,665 | A | 11/1999 | Loftus et al. | 431/116 |
| 5,987,875 | A | 11/1999 | Hillburn et al. | 60/39.05 |
| 5,993,193 | A | 11/1999 | Loftus et al. | 431/8 |
| 6,007,325 | A | 12/1999 | Loftus et al. | 431/8 |
| 6,056,538 | A | 5/2000 | Büchner et al. | 431/115 |
| 6,332,408 | B2 | 12/2001 | Howlett et al. | 110/189 |
| 6,347,935 | B1 | 2/2002 | Schindler et al. | 431/5 |
| 6,383,462 | B1 | 5/2002 | Lang | 423/235 |
| 6,616,442 | B2 | 9/2003 | Venizelos et al. | 431/8 |
| 6,877,980 | B2 * | 4/2005 | Stephens et al. | 431/115 |
| 2004/0018461 | A1 * | 1/2004 | Stephens et al. | 431/115 |

FOREIGN PATENT DOCUMENTS

| | | | |
|---|---|---|---|
| DE | 2944153 | | 5/1981 |
| DE | 3232421 | | 3/1984 |
| DE | 3818265 | | 11/1989 |
| EP | 0099828 | | 6/1988 |
| EP | 0 347 956 | | 12/1989 |
| EP | 0 374 423 | | 6/1990 |
| EP | 0 408 171 | A1 | 1/1991 |
| EP | 000507233 | A2 * | 10/1992 |
| EP | 0 620 402 | A1 | 10/1994 |
| EP | 0 674 135 | B2 | 9/1995 |
| EP | 0 751 343 | | 1/1997 |
| EP | 0486169 | | 1/1998 |
| EP | 1096202 | | 2/2001 |
| EP | 1 211 458 | | 6/2002 |
| FR | 2629900 | | 10/1988 |
| SU | 374488 | | 3/1973 |
| WO | WO03081137 | A1 * | 10/2003 |

OTHER PUBLICATIONS

Straitz III, John F., et al., "Combat NOx With Better Burner Design," *Chemical Engineering*, Nov. 1994, pp. EE-4-EE-8.

Vahdati, M. M., et al., "Design And Development of A Low NOx Coanda Ejector Burner," *Journal of the Institute of Energy*, Mar. 2000, vol. 73, pp. 12-17.

Bussman, Wes, et al., "Low NOx Burner Technology for Ethylene Cracking Furnaces," presented at the *2001 AIChE Spring National Meeting, 13th Annual Ethylene Producers Conference*, Houston, TX, Apr. 25, 2001, pp. 1-23.

Seebold, James G., "Reduce Heater NOx in the Burner," *Hydrocarbon Processing*, Nov. 1982, pp. 183-186.

"West Germany's Caloric Develops a Low-NOx Recycling Fuel Burner," *Chemical Engineering*, Oct. 4, 1982, p. 17.

* cited by examiner

REMOVABLE LIGHT-OFF PORT PLUG FOR USE IN BURNERS

RELATED APPLICATIONS

This patent application claims priority from Provisional Application Ser. No. 60/365,081, filed on Mar. 16, 2002, the contents of which are hereby incorporated by reference.

FIELD OF THE INVENTION

This invention relates to an improvement in a burner of the type employed in high temperature industrial furnaces. More particularly, it relates to an improved design capable of achieving a reduction in $NO_x$ emissions.

BACKGROUND OF THE INVENTION

As a result of the interest in recent years to reduce the emission of pollutants from burners of the type used in large industrial furnaces, significant improvements have been made in burner design. In the past, burner design improvements were aimed primarily at improving heat distribution to provide effective heat transfer. Increasingly stringent environmental regulations have shifted the focus of burner design to the minimization of regulated pollutants.

Oxides of nitrogen ($NO_x$) are formed in air at high temperatures. These compounds include, but are not limited to, nitrogen oxide and nitrogen dioxide. Reduction of $NO_x$ emissions is a desired goal to decrease air pollution and meet government regulations.

The rate at which $NO_x$ is formed is dependent upon the following variables: (1) flame temperature, (2) residence time of the combustion gases in the high temperature zone and (3) excess oxygen supply. The rate of formation of $NO_x$ increases as flame temperature increases. However, the reaction takes time and a mixture of nitrogen and oxygen at a given temperature for a very short time may produce less $NO_x$ than the same mixture at a lower temperature, over a longer period of time.

Strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763. In addition, many raw gas burners produce luminous flames.

Premix burners mix the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a premix burner is the burner of choice for such furnaces. Premix burners can also be designed for special heat distribution profiles or flame shapes required in other types of furnaces.

One technique for reducing $NO_x$ that has become widely accepted in industry is known as staging. With staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ratio closer to stoichiometry. Staging results in reducing peak temperatures in the primary flame zone and has been found to alter combustion speed in a way that reduces $NO_x$. Since $NO_x$ formation is exponentially dependent on gas temperature, even small reductions in peak flame temperature dramatically reduce $NO_x$ emissions. However this must be balanced with the fact that radiant heat transfer decreases with reduced flame temperature, while CO emissions, an indication of incomplete combustion, may actually increase as well.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air is more remotely associated with the fuel. The upper limit of flammability refers to the mixture containing the maximum fuel concentration (fuel-rich) through which a flame can propagate.

U.S. Pat. No. 4,629,413 discloses a low $NO_x$ premix burner and discusses the advantages of premix burners and methods to reduce $NO_x$ emissions. The premix burner of U.S. Pat. No. 4,629,413 lowers $NO_x$ emissions by delaying the mixing of secondary air with the flame and allowing some cooled flue gas to recirculate with the secondary air. The manner in which the burner disclosed achieves light off at start-up and its impact on $NO_x$ emissions is not addressed. The contents of U.S. Pat. No. 4,629,413 are incorporated by reference in their entirety.

U.S. Pat. No. 5,263,849 discloses a burner system for a furnace combustion chamber having an ignition chamber for discharging an ignited combustible mixture of primary air and fuel into the furnace combustion chamber, and a plurality of nozzle ports for directing a high velocity stream of secondary air into the furnace combustion chamber. The system includes a fuel supply and separately controlled primary and secondary air supply lines. U.S. Pat. No. 5,263,849 discloses the use of an igniter that projects angularly into a flame holder. The contents of U.S. Pat. No. 5,263,849 are incorporated by reference in their entirety.

U.S. Pat. No. 5,269,679 discloses a gas-fired burner incorporating an air driven jet pump for mixing air, fuel, and recirculated flue gas. The burner is configured for the staged introduction of combustion air to provide a fuel-rich combustion zone and a fuel-lean combustion zone. A pilot flame is provided through a tube that ignites the air and fuel mixture in a diffuser. Combustion can be observed through a scanner tube. The burner is said to achieve reduced $NO_x$ emission levels in high temperature applications that use preheated combustion air. The contents of U.S. Pat. No. 5,269,679 are incorporated by reference in their entirety.

U.S. Pat. No. 5,092,761 discloses a method and apparatus for reducing $NO_x$ emissions from premix burners by recirculating flue gas. Flue gas is drawn from the furnace through a pipe or pipes by the inspirating effect of fuel gas and combustion air passing through a venturi portion of a burner tube. The flue gas mixes with combustion air in a primary air chamber prior to combustion to dilute the concentration of $O_2$ in the combustion air, which lowers flame temperature and thereby reduces $NO_x$ emissions. The flue gas recirculating system may be retrofitted into existing premix burners or may be incorporated in new low $NO_x$ burners. The contents of U.S. Pat. No. 5,092,761 are incorporated by reference in their entirety.

From the standpoint of $NO_x$ production, a drawback associated with the burner of U.S. Pat. No. 5,092,761 relates to the configuration of the lighting chamber, necessary for achieving burner light off. The design of this lighting chamber, while effective for achieving light off, has been found to be a localized source of high $NO_x$ production during operation. Other burner designs possess a similar potential for localized high $NO_x$ production, since similar configurations are known to exist for other burner designs, some of which have been described hereinabove.

Despite these advances in the art, a need exists for a burner design to meet increasingly stringent $NO_x$ emission regulations by minimizing localized sources of $NO_x$ production.

Therefore, what is needed is a burner for the combustion of fuel wherein localized sources of $NO_x$ production are substantially reduced, yielding further reductions in $NO_x$ emissions.

SUMMARY OF THE INVENTION

The present invention is directed to an improved burner and to a method for combusting fuel in burners of furnaces such as those found in steam cracking. The burner includes a burner tube having a downstream end and an upstream end, a burner tip adjacent a first opening in the furnace, so that combustion of the fuel takes place downstream of the burner tip, a lighting chamber adjacent to the first opening in the furnace, and a removable lighting chamber plug having a shape effective to substantially fill the lighting chamber when positioned within the lighting chamber. A removable lighting chamber plug device suitable is also disclosed.

The method of the present invention includes the steps of combining fuel and air, flue gas or mixtures thereof at a predetermined location, igniting the fuel using an igniter inserted into a lighting chamber which is adjacent a burner tip of the burner, combusting the fuel gas at a combustion zone downstream of the predetermined location and plugging-off the lighting chamber by inserting a removable lighting chamber plug into the lighting chamber.

The method of the present invention may also optionally include the step of drawing a stream of flue gas from the furnace in response to the inspirating effect of uncombusted fuel exiting a fuel orifice and flowing towards the combustion zone.

An object of the present invention is to provide a burner configuration wherein localized sources of $NO_x$ production are reduced. A further object of the present invention is to substantially eliminate a zone of high oxygen concentration adjacent to the combustion zone, in the region of the light-off chamber, reducing $NO_x$ emissions.

These and other objects and features of the present invention will be apparent from the detailed description taken with reference to accompanying drawings.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF THE ILLUSTRATED EMBODIMENTS

Figure 1:
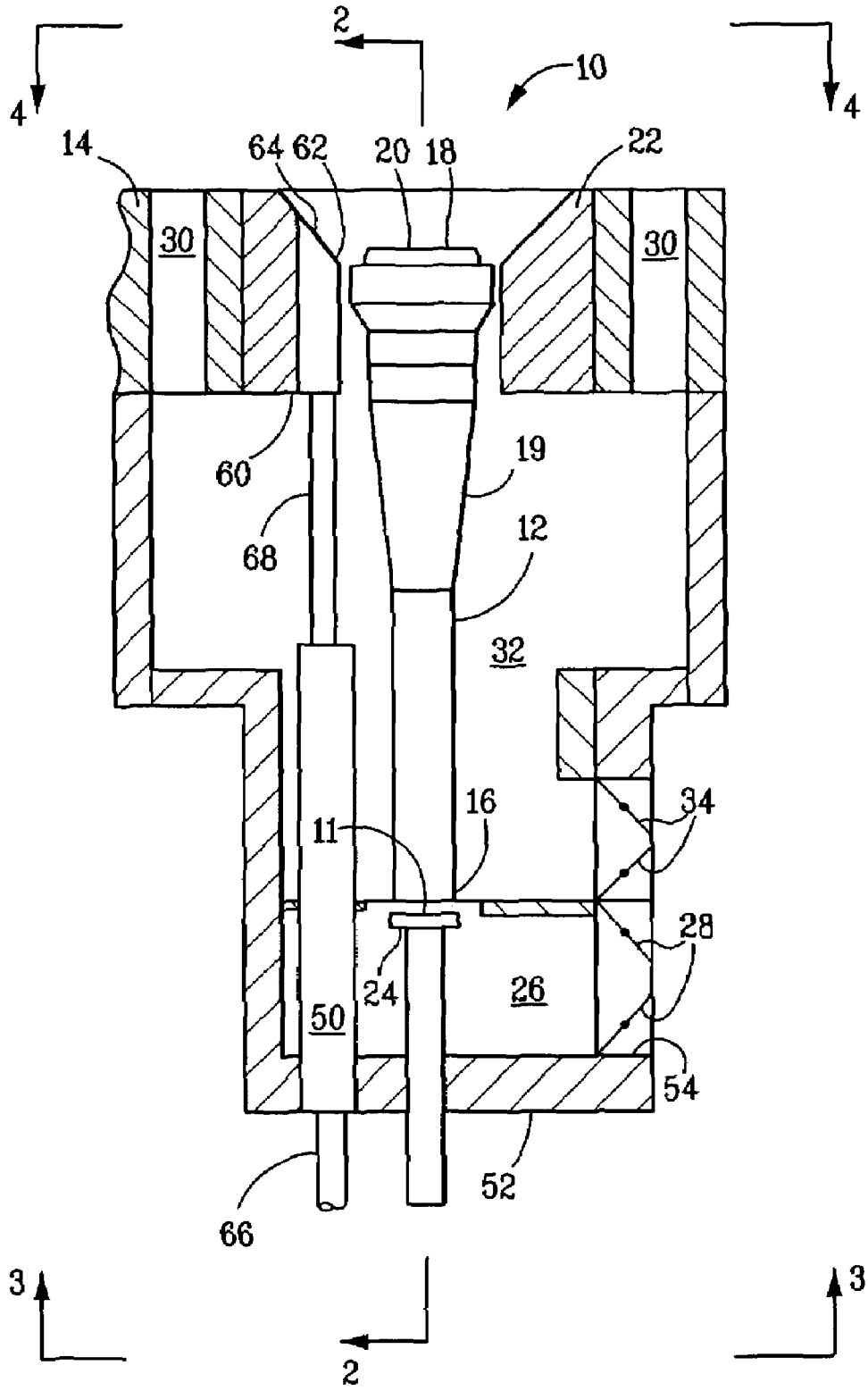
FIG. 1 illustrates an elevation partly in section of an embodiment of the burner of the present invention.

Reference is now made to the embodiments illustrated in FIGS. 1-9, wherein like numerals are used to designate like parts throughout.

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Referring now to FIGS. 1-4, a premix burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by an annular tile 22. A fuel orifice 11, which may be located within gas spud 24, is located at upstream end 16 and introduces fuel gas into burner tube 12. Fresh or ambient air is introduced into primary air chamber 26 through adjustable damper 28 to mix with the fuel gas at upstream end 16 of burner tube 12. Combustion of the fuel gas and fresh air occurs downstream of burner tip 20. Burner 10 may further include steam injection tube 15, which serves to lower $NO_x$ emissions, and enhance mass flow through venturi 19 as is known to those of skill in the art.

A sight and lighting port 50 is provided in the burner 10, to provide access for lighting of the burner through lighting chamber 60. As shown, the lighting port 50 is aligned with lighting chamber 60, which is adjacent to the first opening in the furnace. Lighting chamber 60 is located at a distance from burner tip 20 effective for burner light off. A lighting element (not shown) of the type disclosed in U.S. Pat. No. 5,092,761 has utility in the operation of the present invention, as those skilled in the art will readily understand.

A plurality of air ports 30 originate in secondary air chamber 32 and pass through furnace floor 14 into the furnace. Fresh air enters secondary air chamber 32 through adjustable dampers 34 and passes through staged air ports 30 into the furnace to provide secondary or staged combustion, as described in U.S. Pat. No. 4,629,413.

In order to recirculate flue gas from the furnace to the primary air chamber, ducts or pipes 36, 38 extend from openings 40, 42, respectively, in the floor of the furnace to openings 44, 46, respectively, in burner 10. Flue gas containing, for example, about 0 to about 15% $O_2$ is drawn through pipes 36, 38 with about 5 to about 15% $O_2$ preferred, about 2 to about 10% $O_2$ more preferred and about 2 to about 5% $O_2$ particularly preferred, by the inspirating effect of fuel gas passing through venturi portion 19 of burner tube 12. In this manner, the primary air and flue gas are mixed in primary air chamber 26, which is prior to the zone of combustion. Therefore, the amount of inert material mixed with the fuel is raised, thereby reducing the flame temperature and, as a result, reducing $NO_x$ emissions. Closing or partially closing damper 28 restricts the amount of fresh air that can be drawn into the primary air chamber 26 and thereby provides the vacuum necessary to draw flue gas from the furnace floor.

Unmixed low temperature ambient air, having entered secondary air chamber 32 through dampers 34 and having passed through air ports 30 into the furnace, is also drawn through pipes 36, 38 into the primary air chamber by the inspirating effect of the fuel gas passing through venturi portion 19. The ambient air may be fresh air as discussed above. The mixing of the ambient air with the flue gas lowers the temperature of the hot flue gas flowing through pipes 36, 38 and thereby substantially increases the life of the pipes and permits use of this type of burner to reduce $NO_x$ emission in high temperature cracking furnaces having flue gas temperature above 1900° F. in the radiant section of the furnace.

It is preferred that a mixture of from about 20% to about 80% flue gas and from about 20% to about 80% ambient air should be drawn through pipes 36, 38. It is particularly preferred that a mixture of about 50% flue gas and about 50% ambient air be employed. The desired proportions of flue gas and ambient air may be achieved by proper sizing, placement and/or design of pipes 36, 38 in relation to air ports 30, as those skilled in the art will readily recognize. That is, the geometry of the air ports, including but not limited to their distance from the burner tube, the number of air ports, and the size of the air ports, may be varied to obtain the desired percentages of flue gas and ambient air.

Figure 2:
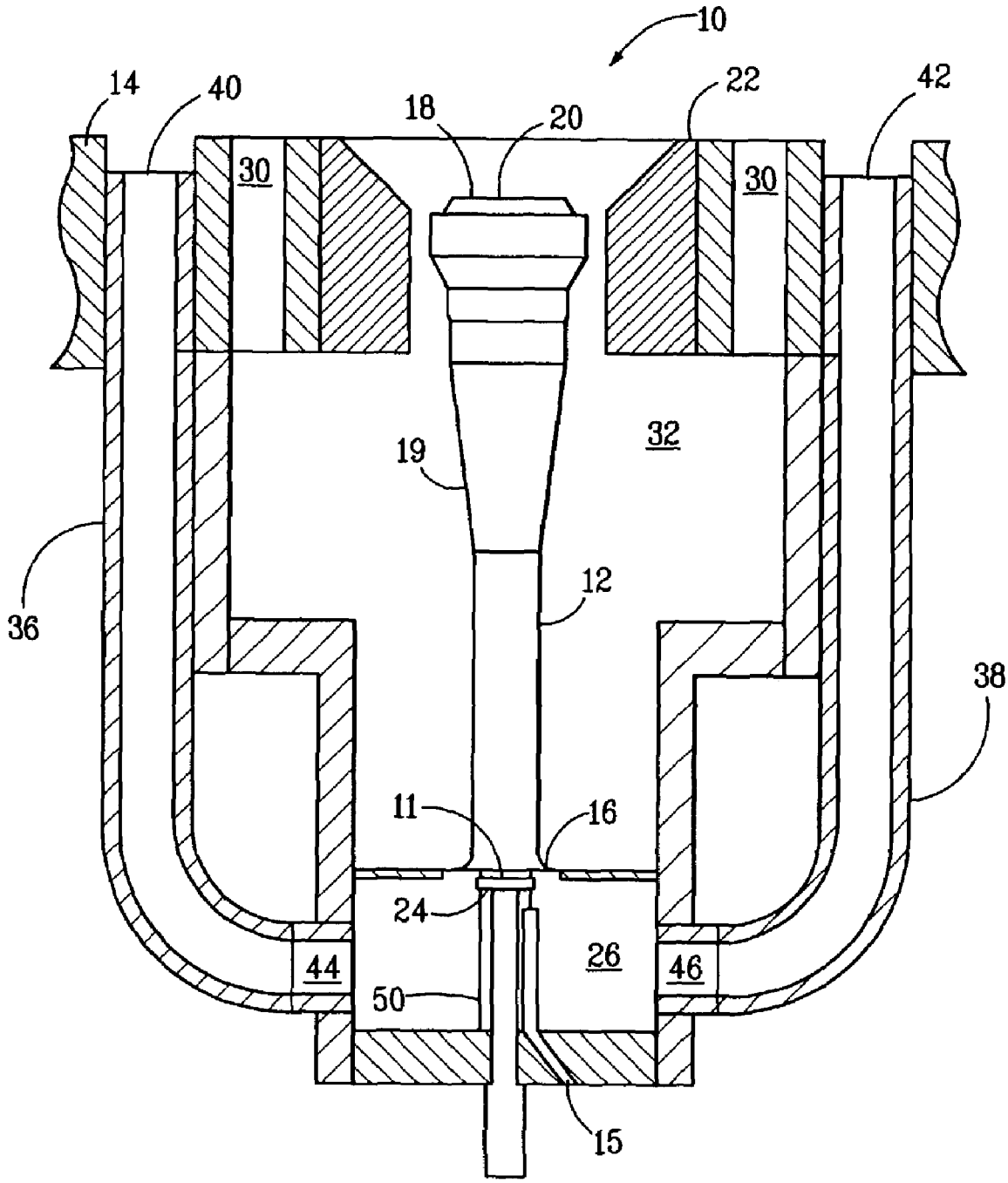
FIG. 2 is an elevation partly in section taken along line 2-2 of FIG. 1.
Figure 3:
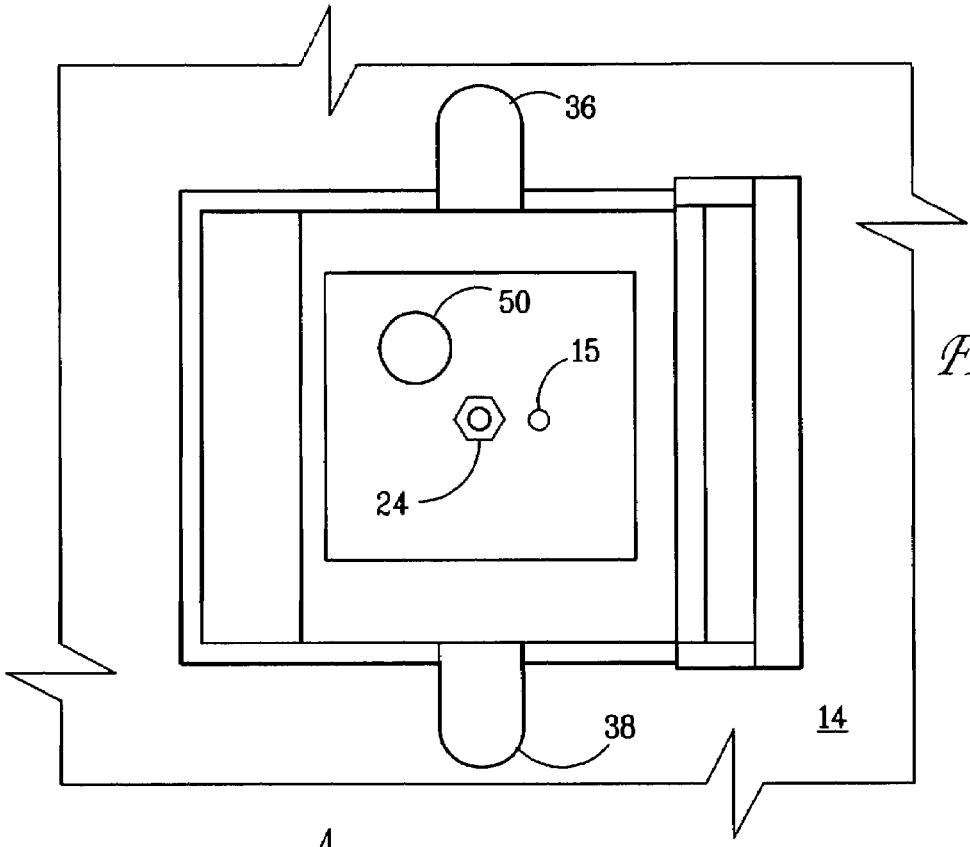
FIG. 3 is a plan view taken along line 3-3 of FIG. 1.
Figure 4:
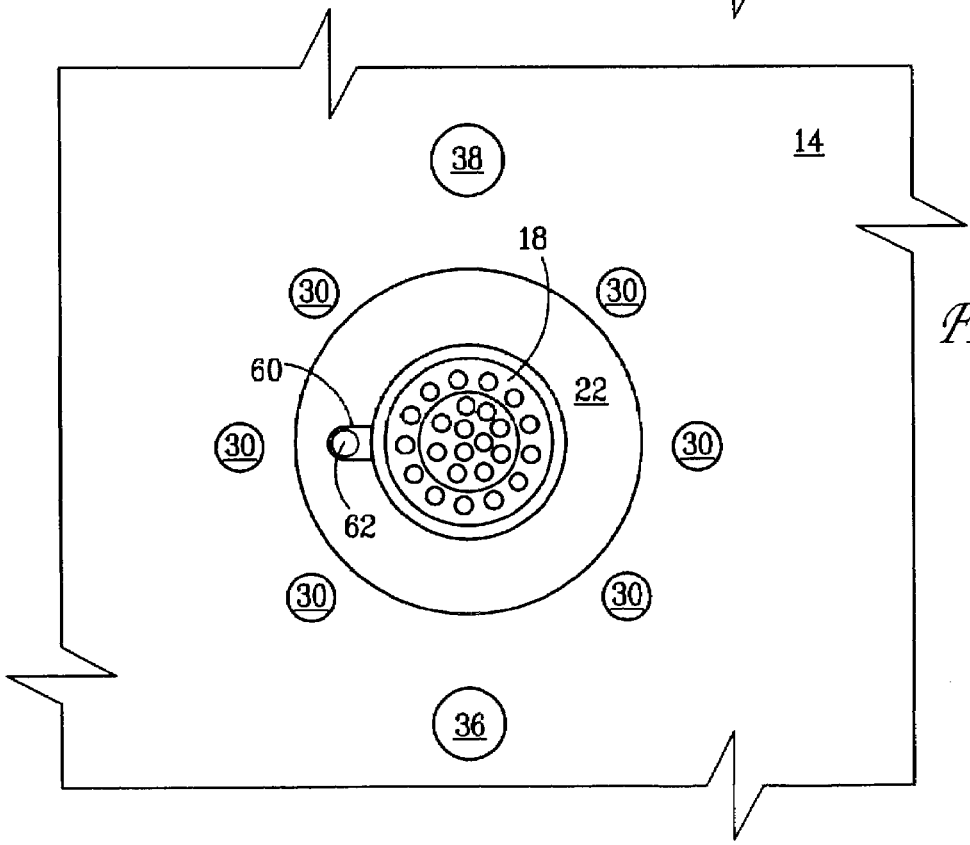
FIG. 4 is a plan view taken along line 4-4 of FIG. 1.

As is shown in FIGS. 1, 2 and 4, a very small gap exists between the burner tip 20 and the burner tile 22. By keeping this gap small, the bulk of the secondary staged air is forced to enter the furnace through staged air ports 30 located some distance from the primary combustion zone, which is located immediately on the furnace side of the burner tip 20.

It has been discovered through testing that increasing the gap between the burner tip 20 and the burner tile 22 raises overall $NO_x$ but also raises overall flame stability. The size of the annular gap should be sized such that it is small enough to minimize $NO_x$, and large enough to maintain adequate flame stability. In this regard, lighting chamber 60 may be seen to pose a problem. To substantially eliminate the effect on $NO_x$ emissions created by the presence of lighting chamber 60, which provides a significant cross-sectional flow area for additional air to pass, a removable lighting chamber plug 62 having a shape effective to substantially fill lighting chamber 60 when positioned within lighting chamber 60 is provided.

To operate the burner of the present invention, a torch or igniter is inserted through light-off tube 50 into the lighting chamber 60, which is adjacent to the primary combustion area and burner tip 20, to light the burner. Following light-off, the lighting chamber 60 is plugged-off by inserting removable lighting chamber plug 62 through light-off tube 50 into the lighting chamber 60, for normal operation, eliminating the zone of high oxygen concentration adjacent to the primary combustion zone, and thus reducing the $NO_x$ emissions from the burner. For ease of installation, the lighting chamber plug 62 may be affixed to an installation rod 66, to form lighting chamber plug assembly 68, which is inserted through light-off tube 50 into lighting chamber 60. The construction of the removable lighting chamber plug assembly 68 allows convenient attachment to the burner plenum 52 through conventional mechanical attachment of installation rod 66 to burner plenum 52.

The removable lighting chamber plug 62 and assembly is advantageously constructed of materials adequate for the high temperature environment inside the furnace. The face 64 of the removable lighting chamber plug 62, which is the surface exposed to the furnace and which fits into burner tile 22, may be profiled to form an extension of the axi-symetric geometry of the burner tile 22, thus creating a flush mounting with the burner tile 22, as shown in FIG. 1. The lighting chamber plug 62 should be constructed of a ceramic or high temperature refractory material suitable for temperatures in the range of 2600-3600° F., as is typical for furnace burner tiles. One material having utility in the practice of the present invention is a ceramic fiber blanket, such as Kaowool® Ceramic Fiber Blanket, which may be obtained from Thermal Ceramics Corporation of Atlanta, Ga., in commercial quantities.

As may be appreciated, the burner plenum may be covered with mineral wool and wire mesh screening 54 to provide insulation therefor.

Figure 5:
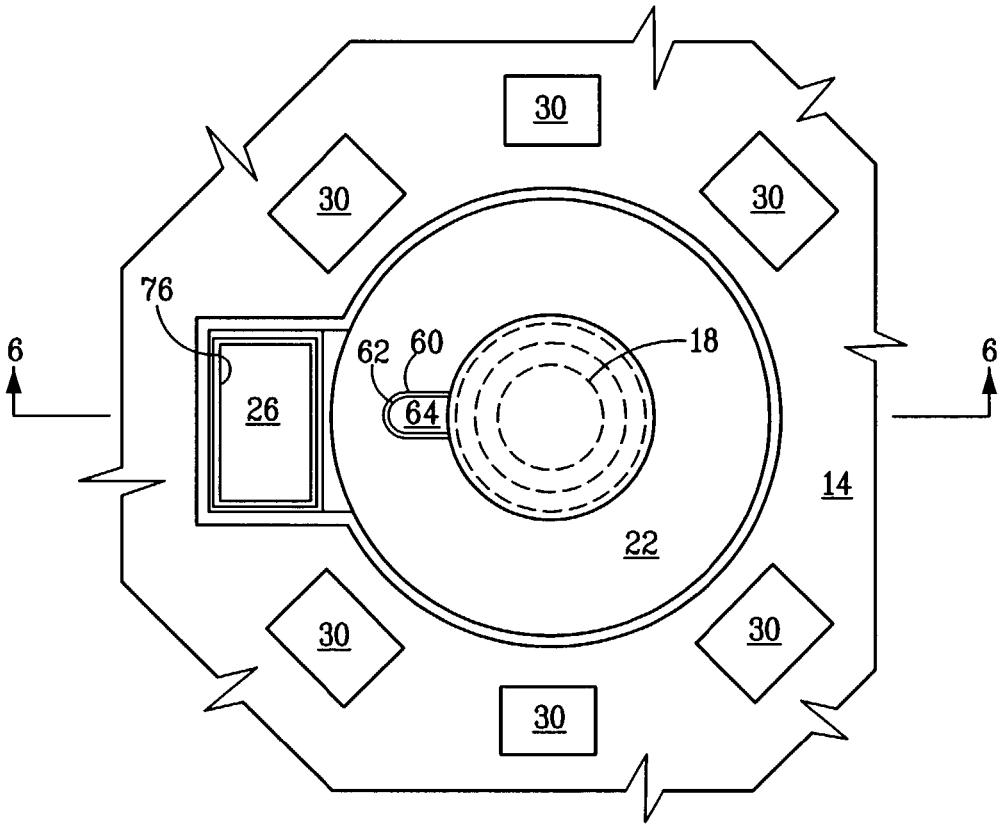
FIG. 5 is a plan view taken along line 5-5 of FIG. 6.
Figure 6:
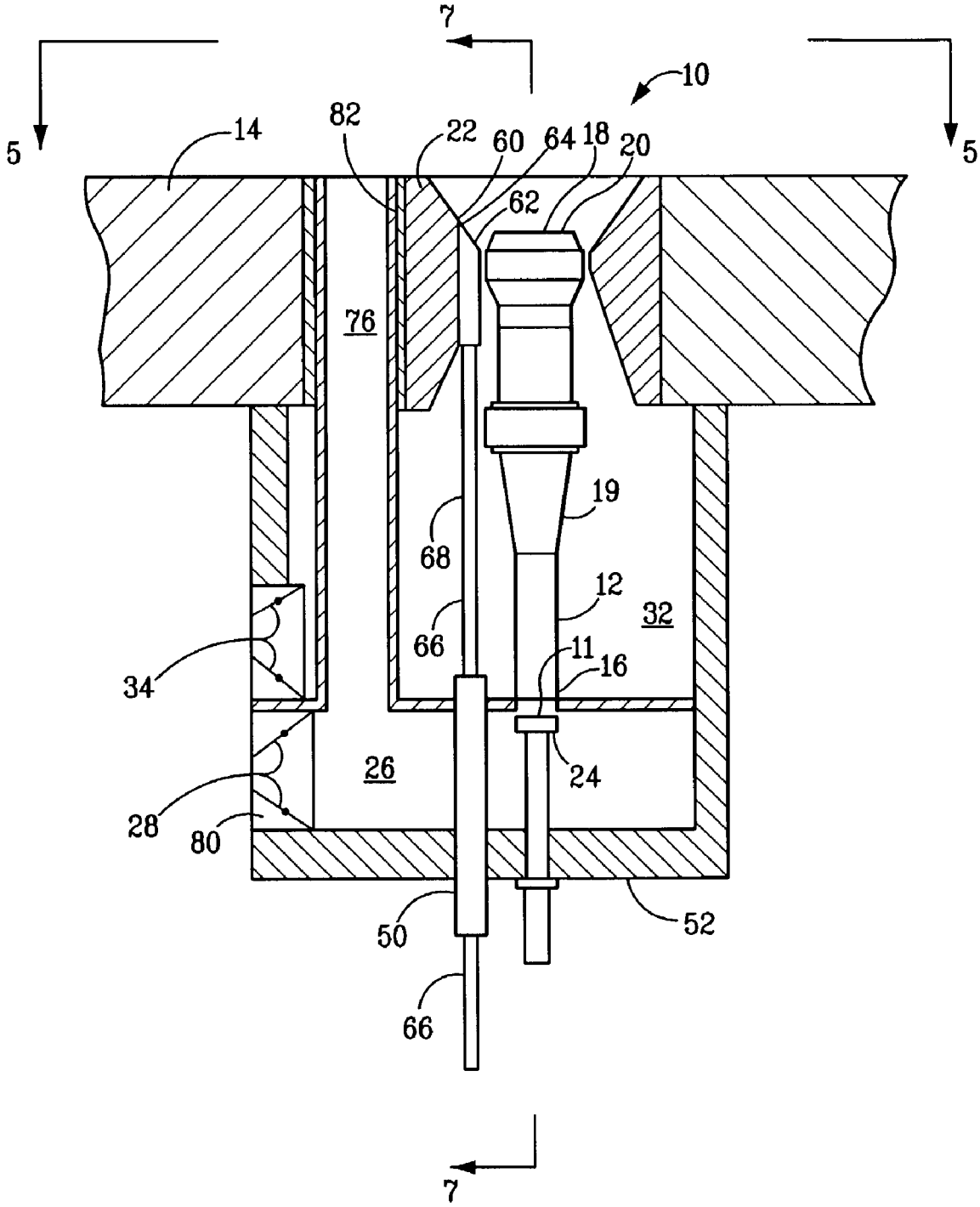
FIG. 6 is an elevation partly in section of a third embodiment of the burner of the present invention.
Figure 7:
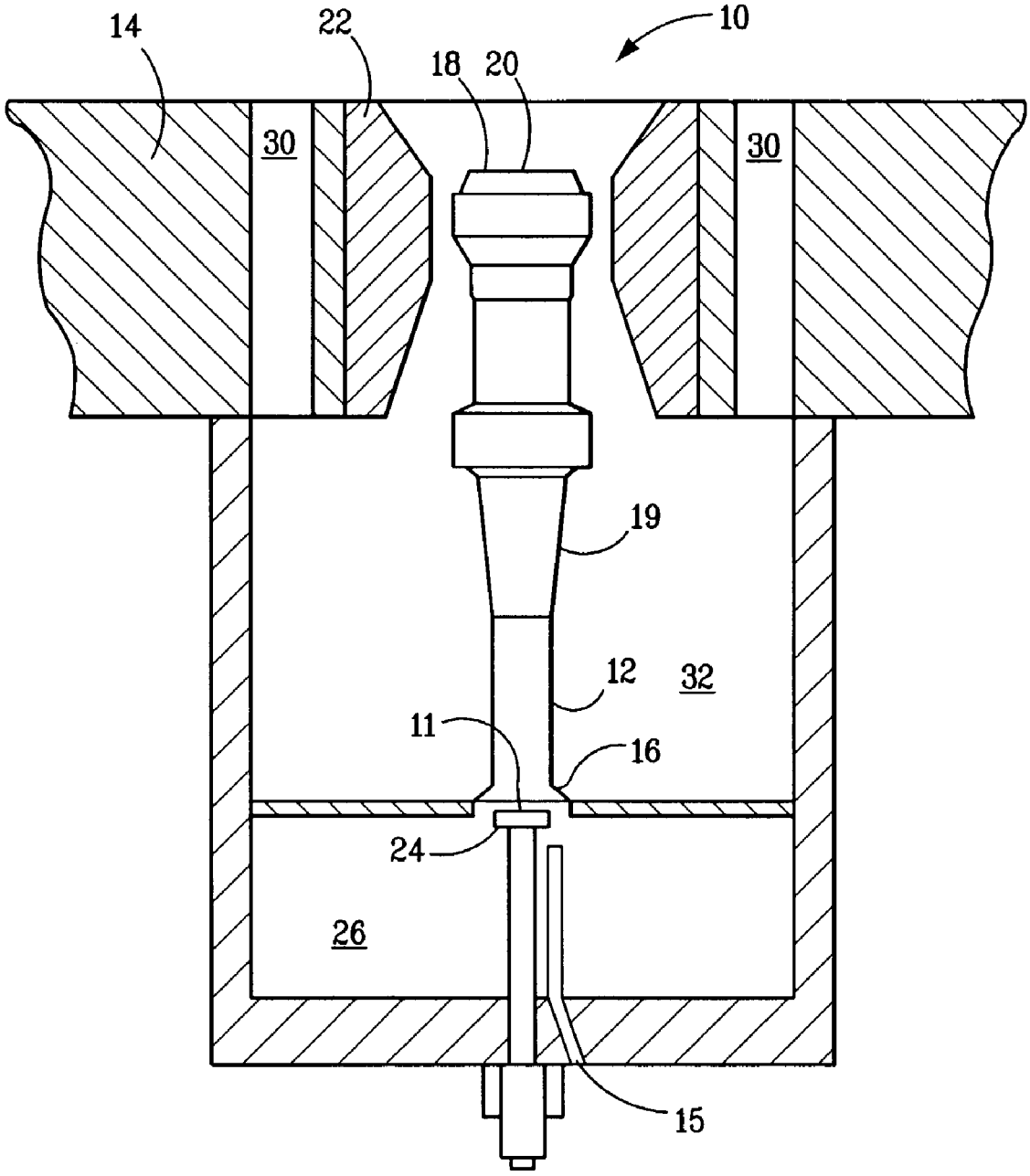
FIG. 7 is an elevation partly in section taken along line 7-7 of FIG. 6.

The removable lighting chamber plug of the present invention may also be used in a low $NO_x$ burner design of the type illustrated in FIGS. 5-7, wherein like reference numbers indicate like parts. As with the embodiment of FIGS. 1-4, a premix burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by an annular tile 22. A fuel orifice 11, which may be located within gas spud 24, is located at upstream end 16 and introduces fuel gas into burner tube 12. Fresh or ambient air is introduced into primary air chamber 26 through adjustable damper 28 to mix with the fuel gas at upstream end 16 of burner tube 12. Combustion of the fuel gas and fresh air occurs downstream of burner tip 20.

Sight and lighting port 50 provides access to the interior of burner 10 for lighting element (not shown). As with the embodiment of the present invention depicted in FIGS. 1-4, a lighting element of the type disclosed in U.S. Pat. No. 5,092,761 has utility in this embodiment of the present invention. Sight and lighting port 50 allows inspection of the interior of the burner assembly and access for lighting of the burner through lighting chamber 60. Sight and lighting port 50 is aligned with lighting chamber 60, which is adjacent to the first opening in the furnace. Lighting chamber 60 is located at a distance from burner tip 20 effective for burner light-off.

As will be appreciated by those skilled in the art, for the case when a pilot is used rather than the lighting element depicted in FIGS. 1-4, an annular plug can be advantageously employed to fill the annular gap around the pilot. In this case, similar benefits are achieved by the elimination of the high oxygen zone ordinarily present in the area of the annular gap.

A plurality of air ports 30 originate in secondary air chamber 32 and pass through furnace floor 14 into the furnace. Fresh air enters secondary air chamber 32 through adjustable dampers 34 and passes through staged air ports 30 into the furnace to provide secondary or staged combustion.

In order to recirculate flue gas from the furnace to the primary air chamber, a flue gas recirculation passageway 76 is formed in furnace floor 14 and extends to primary air chamber 26, so that flue gas is mixed with fresh air drawn into the primary air chamber from opening 80 through dampers 28. Flue gas containing, for example, about 0 to about 15% $O_2$ is drawn through passageway 76 with about 5 to about 15% $O_2$ preferred, about 2 to about 10% $O_2$ more preferred and about 2 to about 5% $O_2$ particularly preferred, by the inspirating effect of fuel gas passing through venturi portion 19 of burner tube 12. As with the embodiment of FIGS. 1-4, the primary air and flue gas are mixed in primary air chamber 26, which is prior to the zone of combustion. Closing or partially closing damper 28 restricts the amount of fresh air that can be drawn into the primary air chamber 26 and thereby provides the vacuum necessary to draw flue gas from the furnace floor.

As with the embodiment of FIGS. 1-4, a mixture of about 20 to about 80% flue gas and from about 20 to about 80% ambient air is drawn through flue gas recirculation passageway 76. The desired proportions of flue gas and ambient air may be achieved by proper sizing, placement and/or design of flue gas recirculation passageway 76 and air ports 30; that is, the geometry and location of the air ports may be varied to obtain the desired percentages of flue gas and ambient air.

As indicated, the presence of lighting chamber 60 provides a significant cross-sectional flow area for additional air to pass. To substantially reduce $NO_x$ emissions created in the region of the lighting chamber 60, a removable lighting chamber plug 62, having a shape effective to substantially fill lighting chamber 60 when positioned within lighting chamber 60, is provided.

To operate the burner of FIGS. 5-7, a torch or igniter is inserted through sight and lighting port 50 into the lighting chamber 60, which is adjacent primary combustion zone and burner tip 20, to light the burner. Following light-off, the lighting chamber 60 is plugged-off by inserting removable lighting chamber plug 62 through light-off port 50 into the lighting chamber 60, for normal operation, eliminating the zone of high oxygen concentration adjacent to the primary combustion zone, and thus reducing the $NO_x$ emissions from the burner. For ease of installation, the lighting chamber plug 62 may be affixed to an installation rod 66, to form lighting chamber plug assembly 68, which is inserted through light-off port 50 into lighting chamber 60. The construction of the removable lighting chamber plug assembly 68 allows convenient attachment to the burner plenum 86 through conventional mechanical attachment of installation rod 66 to burner plenum 52.

The removable lighting chamber plug 62 is advantageously constructed of materials adequate for the high temperature environment inside the furnace. The face 64 of the removable lighting chamber plug 62, which is the surface exposed to the furnace and which fits into burner tile 22, may be profiled to form an extension of the axi-symetric geometry of the burner tile 22, thus creating a flush mounting with the burner tile 22, as shown in FIGS. 5 and 6. The lighting chamber plug 62 of the removable lighting chamber plug 62, which fits into the burner tile 22, should be constructed of a ceramic or high temperature refractory material suitable for temperatures in the range of 2600-3600° F. One material having utility in the practice of the present invention is a ceramic fiber blanket, such as Kaowool® Ceramic Fiber Blanket, which may be obtained from Thermal Ceramics of Atlanta, Ga. in commercial quantities.

A similar benefit can be achieved in flat-flame burners, as will now be described by reference to FIGS. 8-9. A premix burner 110 includes a freestanding burner tube 112 located in a well in a furnace floor 114. Burner tube 112 includes an upstream end 116, a downstream end 118 and a venturi portion 119. Burner tip 120 is located at downstream end 118 and is surrounded by a peripheral tile 122. A fuel orifice 111, which may be located within gas spud 124, is located at upstream end 116 and introduces fuel gas into burner tube 112. Fresh or ambient air is introduced into primary air chamber 126 to mix with the fuel gas at upstream end 116 of burner tube 112. Combustion of the fuel gas and fresh or ambient air occurs at burner tip 120. Fresh or ambient secondary air enters secondary chamber 132 through dampers 134.

In order to recirculate flue gas from the furnace to the primary air chamber, a flue gas recirculation passageway 176 is formed in furnace floor 114 and extends to primary air chamber 126, so that flue gas is mixed with fresh air drawn into the primary air chamber from opening 180 through dampers 128. Flue gas containing, for example, 0 to about 15% $O_2$ is drawn through passageway 176 by the inspirating effect of fuel gas passing through venturi portion 119 of burner tube 112. Primary air and flue gas are mixed in primary air chamber 126, which is prior to the zone of combustion.

Figure 9:
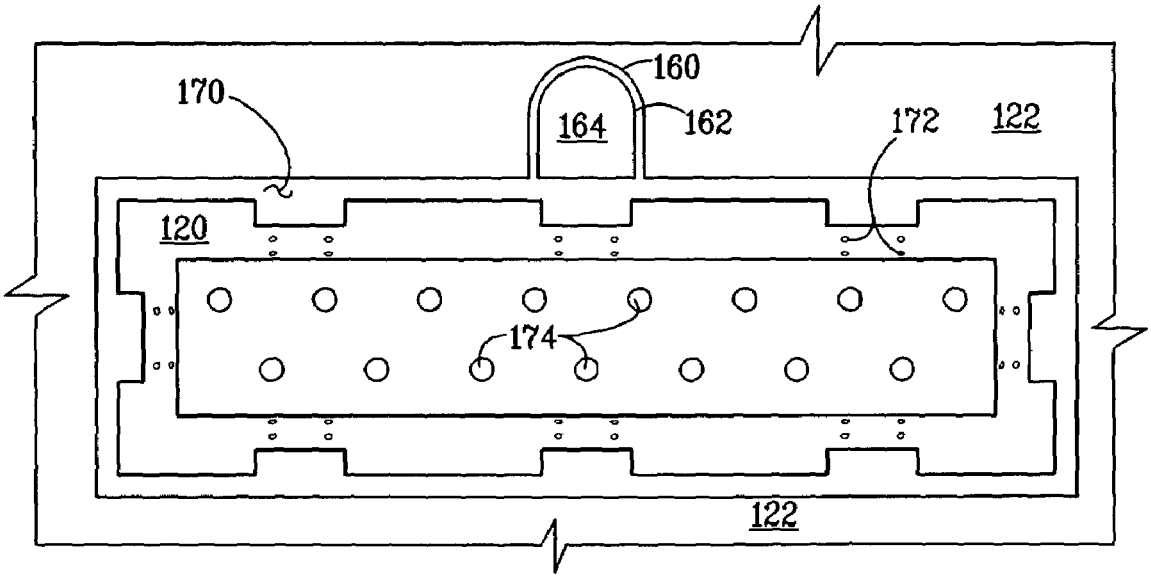
FIG. 9 is a top view of the FIG. 8 embodiment of a flat-flame burner.

As is shown in FIG. 9, an air gap 170 exists between the burner tip 120 and the burner tile 122. By properly engineering this gap, the bulk of the secondary staged air is forced to enter the furnace through staged air ports (not shown) located some distance from the primary combustion zone, which is located immediately on the furnace side of the burner tip 120.

Referring again to FIG. 8, in operation, a fuel orifice 111, which may be located in gas spud 124 discharges fuel into burner tube 112, where it mixes with primary air and recirculated flue-gas. The mixture of fuel gas, recirculated flue-gas and primary air then discharges from burner tip 120. The mixture in the venturi portion 119 of burner tube 112 is maintained below the fuel-rich flammability limit; i.e. there is insufficient air in the venturi to support combustion. Staged, secondary air is added to provide the remainder of the air required for combustion. The majority of the staged air is added a finite distance away from the burner tip 120 through staged air ports (not shown). However, a portion of the staged, secondary air passes between the burner tip 120 and the peripheral tile 122 and is immediately available to the fuel exiting the side ports 172. As indicated, side-ports 172 direct a fraction of the fuel across the face of the peripheral tile 122, while main ports 174 direct the major portion of the fuel into the furnace.

Two combustion zones are established. A small combustion zone is established across the face of the peripheral tile 122, emanating from the fuel gas combusted in the region of the side-ports 172, while a much larger combustion zone is established projecting into the furnace firebox, emanating from the fuel gas combusted from the main ports 174. The combustion zone adjacent to the side ports 172 and peripheral tile 122 is important in assuring flame stability. To provide adequate flame stability, the air/fuel mixture in this zone, which comprises the air/fuel mixture leaving the side ports 172 of burner tip 120, plus the air passing between the burner tip 120 and the peripheral tile 122, must be above the fuel-rich flammability limit.

While a mixture above the fuel-rich flammability limit in the combustion zone adjacent to the side ports 172 and peripheral tile 122 assures good burner stability, combustion in this zone will generate relatively high $NO_x$ levels compared to the larger combustion zone. Overall $NO_x$ emissions may be reduced by minimizing the proportion of fuel that is combusted in this smaller combustion zone. This is achieved by assuring that the air flow between burner tip 120 and the peripheral tile 122 is such that combustion takes place within this zone with a mixture sufficiently above the fuel-rich flammability limit to assure good burner stability, but without the high oxygen concentrations that lead to high NOx emissions.

It has been discovered that increasing the gap between the burner tip 120 and the burner tile 122 raises overall $NO_x$ but also raises overall flame stability. The size of the peripheral gap should be such that it is small enough to minimize $NO_x$, and large enough to maintain adequate flame stability. In this regard, lighting chamber 160 may be seen to pose a problem. To substantially eliminate the effect on $NO_x$ emissions created by the presence of lighting chamber 160, which provides a significant cross-sectional flow area for additional air to pass, a removable lighting chamber plug 162 having a shape effective to substantially fill lighting chamber 160 when positioned within lighting chamber 160 is provided.

To operate the burner of the present invention, a torch or igniter is inserted through light-off tube 150 into the lighting chamber 160, which is adjacent to the primary combustion area and burner tip 120, to light the burner. Following light-off, the lighting chamber 160 is plugged-off by inserting removable lighting chamber plug 162 through light-off tube 150 into the lighting chamber 160, for normal operation, eliminating the zone of high oxygen concentration adjacent to the primary combustion zone, and thus reducing the $NO_x$ emissions from the burner. For ease of installation, the lighting chamber plug 162 may be affixed to an installation rod 166, to form lighting chamber plug assembly 168, which is inserted through light-off tube 150 into lighting chamber 160. The construction of the removable lighting chamber plug assembly 168 allows convenient attachment to the burner plenum 152 through conventional mechanical attachment.

Figure 8:
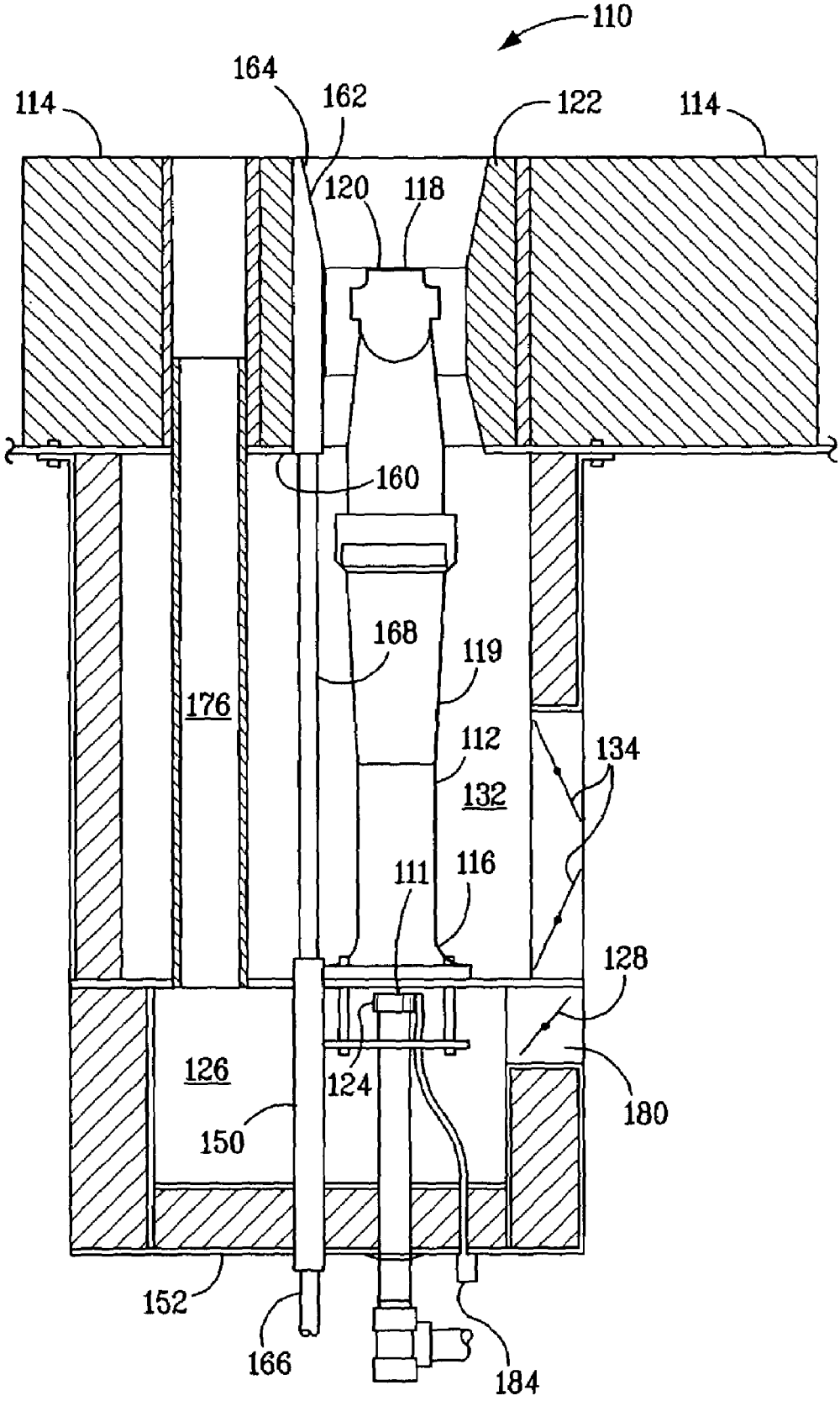
FIG. 8 is an elevation partly in section of the embodiment of a flat-flame burner.

For the embodiment of FIGS. 8-9, the removable lighting chamber plug 162 and assembly 168 is constructed of materials adequate for the high temperature environment inside the furnace. The face 164 of the removable lighting chamber plug 162, which is the surface exposed to the furnace and which fits into burner tile 122, may be profiled to form an extension of the geometry of the burner tile 122, thus creating a flush mounting with the burner tile 122, as shown in FIG. 8. The lighting chamber plug 162 should be constructed of a ceramic or high temperature refractory material suitable for temperatures in the range of 2600-3600° F., as is typical for furnace burner tiles. Again, Kaowool® Ceramic Fiber Blanket, which may be obtained from Thermal Ceramics Corporation of Atlanta, Ga., may be used.

Unlike prior designs, use of the light-off port plug of the present invention serves to substantially minimize localized sources of high $NO_x$ emissions in the region near the burner tip, as demonstrated by the Examples below.

As will be appreciated by those skilled in the art, the light-off port plug of the present invention may be employed in a variety of other burner designs. For example, similar benefits can be achieved for raw gas burners, non pre-mix, staged-air burners, burners that do not employ flue gas recirculation, staged fuel burners and the like.

It will also be understood that the light-off port plug described herein also has utility in traditional raw gas burners and raw gas burners having a pre-mix burner configuration wherein flue gas alone is mixed with fuel gas at the entrance to the burner tube. In fact, it has been found that the pre-mix, staged-air burners of the type described in detail herein can be operated with the primary air damper doors closed, with very satisfactory results.

In addition to the use of flue gas as a diluent, another technique to achieve lower flame temperature through dilution is through the use of steam injection. (See steam injection tube 15 of FIG. 2 and FIG. 7 and steam injection tube 184 of FIG. 8. Steam injection can be injected in the primary air of the secondary air chamber. Preferably, steam may be injected upstream of the venturi.

EXAMPLES

Example 1

To assess the benefits of the present invention, computational fluid dynamics, CFD, were used to evaluate the configurations described below. A CFD analysis solves fundamental controlling equations and provides fluid velocity, species, combustion reactions, pressure, heat transfer and temperature values, etc. at every point in the solution domain. FLUENT™ software from Fluent Inc. was used to perform the analysis. (Fluent, Inc., USA, 10 Cavendish Court, Centerra Resource Park, Lebanon, N.H., 03766-1442).

In order to demonstrate the benefits of the present invention, the operation of a pre-mix burner employing flue gas recirculation of the type described in U.S. Pat. No. 5,092,761 (as depicted in FIG. 5 of U.S. Pat. No. 5,092,761), was simulated to establish the baseline data using the FLUENT software package. Results were to be obtained of the temperature profile achieved for a detailed material and energy balance calculated using the FLUENT computational fluid dynamics software for the baseline burner.

Example 2

In Example 2 the burner light-off plug of the present invention was simulated for the same material balance as in the Example 1 existing burner. A temperature profile for the detailed material and energy balance was obtained using the FLUENT computational fluid dynamics software. Results obtained showed a more uniform temperature profile. Experience has shown that this can be expected to reduce the $NO_x$ emissions of the burner.

Example 3

To further demonstrate the benefits of the present invention, a pre-mix burner, without the light-off port plug of the present invention, employing flue gas recirculation of the type described in U.S. Pat. No. 5,092,761 (as depicted in FIG. 5), was operated at a firing rate of 6 million BTU/hr., using a fuel gas comprised of 30% $H_2$/70% natural gas, with steam injected at the following rates: 0 lb./hr., and 196 lb./hr. $NO_x$ emission levels were 88 ppm, and 49 ppm, respectively.

Example 4

A light-off port plug of the present invention comprised of Kaowool® Ceramic Fiber Blanket was installed in the pre-mix burner of Example 3. The burner was operated at a firing rate of 6 million BTU/hr., with a fuel gas comprised of 30% $H_2$/70% natural gas, with steam injected at the following rates: 0 lb./hr., and 195 lb./hr. $NO_x$ emission levels were 73 ppm, and 37 ppm, respectively.

As may be appreciated by those skilled in the art, the present invention can be incorporated in new burners or can be retrofitted into existing burners.

Although illustrative embodiments have been shown and described, a wide range of modification, change and substitution is contemplated in the foregoing disclosure and in some instances, some features of the embodiment may be employed without a corresponding use of other features. Accordingly, it is appropriate that the appended claims be construed broadly and in a manner consistent with the scope of the embodiments disclosed herein.

What is claimed is:

1. A pre-mix burner having a primary air chamber and a secondary air chamber for the staged combustion of fuel and air, said burner comprising:

(a) a burner tube having a downstream end and an upstream end, said burner tube for mixing air from the primary air chamber with fuel at said upstream end;

(b) a burner tip surrounded by a peripheral burner tile adjacent the downstream end of said burner tube, so that combustion of the fuel takes place downstream of said burner tip;

(c) a lighting chamber, said lighting chamber formed within said peripheral burner tile and adjacent the downstream end of said burner tube;

(d) a removable lighting chamber plug positioned within said lighting chamber to substantially fill and plug-off said lighting chamber and eliminate a zone of high oxygen concentration; and (e) a plurality of air ports for receiving air from the secondary air chamber to provide staged combustion;

wherein said removable lighting chamber plug reduces $NO_x$ emissions during combustion over the burner without said removable lighting chamber plug.

2. The burner according to claim 1, further comprising a sight and lighting port located in an interior wall of said burner and aligned with said lighting chamber.

3. The burner according to claim 2, wherein said lighting chamber plug assembly is inserted through said sight and light-off port into said lighting chamber.

4. The burner according to claim 1, wherein said upstream end of said burner tube receives fuel and air, flue gas or mixtures thereof.

5. The burner according to claim 1, wherein said lighting chamber is located at a distance from said burner tip and is effective for burner light-off.

6. The burner according to claim 1, wherein said burner tip is mounted on said downstream end of said burner tube.

7. The burner according to claim 1, wherein said removable lighting chamber plug includes a face for exposure to the burner tip which is profiled for flush mounting with said burner tile.

8. The burner according to claim 7, wherein said face is constructed of a ceramic or high temperature refractory material.

9. The burner according to claim 1, wherein said removable lighting chamber plug is formed from a ceramic fiber blanket material.

10. The burner according to claim 9, wherein said lighting chamber plug assembly is inserted through a sight and light-off port into said lighting chamber.

11. The burner according to claim 1, wherein the fuel comprises fuel gas.

12. The burner according to claim 1, further comprising a fuel spud located adjacent the upstream end of said burner tube, for introducing fuel into said burner tube.

13. The burner according to claim 1, wherein said burner is a flat-flame burner.

* * * * *